United States Patent [19]

Carter et al.

[11] 4,405,156

[45] Sep. 20, 1983

[54] REINFORCED HINGE FOR BOOK COVER

[75] Inventors: Leewood C. Carter, Warren; Robin P. Neary, Basking Ridge, both of N.J.

[73] Assignee: Book Covers, Inc., Newark, N.J.

[21] Appl. No.: 249,089

[22] Filed: Mar. 30, 1981

[51] Int. Cl.[3] ..... B42C 7/00

[52] U.S. Cl. ..... 281/29; 412/3

[58] Field of Search ..... 281/29, 36, 37; 412/3, 412/4, 5

[56] References Cited

U.S. PATENT DOCUMENTS

| | | | |
|---|---|---|---|
| 1,202,979 | 10/1916 | Edwards | 281/37 |
| 2,434,502 | 1/1948 | Martin et al. | 281/29 |
| 3,145,033 | 8/1964 | Caddoo | 281/29 |

FOREIGN PATENT DOCUMENTS

| | | | |
|---|---|---|---|
| 809074 | 7/1951 | Fed. Rep. of Germany | 281/29 |
| 2358290 | 6/1974 | Fed. Rep. of Germany | 281/29 |
| 2813746 | 10/1978 | Fed. Rep. of Germany | 281/36 |
| 1054538 | 2/1954 | France | 281/29 |
| 6709968 | 1/1968 | Netherlands | 281/29 |
| 724987 | 2/1955 | United Kingdom | 281/29 |

*Primary Examiner*—Paul A. Bell

*Attorney, Agent, or Firm*—Weinstein & Sutton

[57] ABSTRACT

A book cover having a reinforced hinge including a reinforcing member secured to the edges of the leafboards of the book cover, a hinge member secured to the outer surface of the reinforcing member, and a central lining paper adhered to the inner surface of the reinforcing member, so that the composite structure cooperates to form a reinforced hinge for a book cover.

13 Claims, 3 Drawing Figures

REINFORCED HINGE FOR BOOK COVER

FIELD OF THE INVENTION

The present invention relates generally to improved book covers and, more particularly, to a book cover including a reinforced hinge and to a method of making same.

BACKGROUND OF THE INVENTION

Book covers are typically formed from two spaced-apart leafboards formed of laminated paperboard material, with the spaced-apart leafboards being connected together by a hinge member, as shown, for example, in U.S. Pat. No. 3,145,033. As disclosed in this patent, a tape member connects the two leafboards together and forms the hinge for the book cover. However, it has been found that a hinge member formed in this manner does not have the required strength to resist tearing and ripping as a result of the book being opened and closed continuously, and as a result of books being pulled from their shelves by the hinge member.

There have been previous attempts to strengthen the hinge member of book covers, and one example is found in U.S. Pat. No. 3,318,618. In this book cover, the edges of the hinge material are sandwiched between the layers of each of the front and back leafboards of the book cover, and the hinge is formed between the inner edges of the leafboards and the spine section. However, these hinge sections are relatively thin and also become weakened after use and have a tendency to tear or crack.

Also of interest is U.S. Pat. No. 3,228,709 which includes a cover board extending the entire width of the book cover. Although a central narrow strip reinforces the cover board at its center, hinge areas between the central narrow strip and the leafboard are not reinforced.

Accordingly, it is an object of the present invention to provide a book cover having a reinforced hinge and a method of forming same which overcomes the aforesaid problems. Specifically, it is within the contemplation of the present invention to provide an improved reinforced hinge member for a book cover and method of making same, wherein the reinforced hinge is much stronger and durable than hinge members for book covers used in the past.

It is also an object of the present invention to provide a book cover having a reinforced hinge member which does not increase the thickness of the leafboards at the portion where the hinge member overlaps the leafboards.

SUMMARY OF THE INVENTION

Briefly, in accordance with the principles of the present invention, there is provided a book cover including a reinforced hinge, wherein two spaced-apart leafboards are connected by a reinforcing scrim member which overlaps edge portions of the leafboards and is glued thereto. The reinforcing scrim member can be formed of any suitable material, such as nylon, cheesecloth, polyester, rayon, olefins, acrylics, acetates, or cotton. A paperboard hinge member overlaps and is adhered to the reinforcing member and extends beyond the edges of the reinforcing member to also overlap the leafboards, and the hinge member is directly adhered to the edge portions of the leafboards, by glue or the like. This hinge member could also be made from vinyl, or a similar material, which would be suitable for di-electric heat sealing of the cover. This direct adherence of the hinge member to the leafboard provides a better and superior bond, as compared to adhering the hinge member to the reinforcing member and then adhering the reinforcing member to the leafboard.

Next, a lining paper strip is secured to the inner surface of the reinforcing member and is arranged so that its edges are spaced apart from the edge portions of the leafboards.

In addition, in the preferred embodiment, the edge portions of the leafboards are indented by applying pressure thereto and are indented by an amount at least equal to the thickness of the reinforcing member and the paper hinge member so that the thickness of the leafboards are not increased by the overlapping reinforcing member and hinge member.

Advantageously, as a result of the present invention, the reinforcing member, the outer paper hinge member, and the inner lining paper are all glued together and cooperate to form an improved reinforced hinge for the book cover which has greater strength and durability to resist tearing and/or cracking during continued use. In addition, the fact that the edge portions of the leafboards are indented to receive the reinforcing scrim member and hinge member, the overall thickness of the leafboards is not increased as a result of the improved reinforced hinge of the present invention.

BRIEF DESCRIPTION OF THE DRAWINGS

Further objects, features, and advantages of the present invention will become apparent upon the consideration of the following detailed description of a presently preferred embodiment, when taken in conjunction with the accompanying drawings, wherein.

DETAILED DESCRIPTION OF PREFERRED EMBODIMENT OF THE INVENTION

Figure 1:
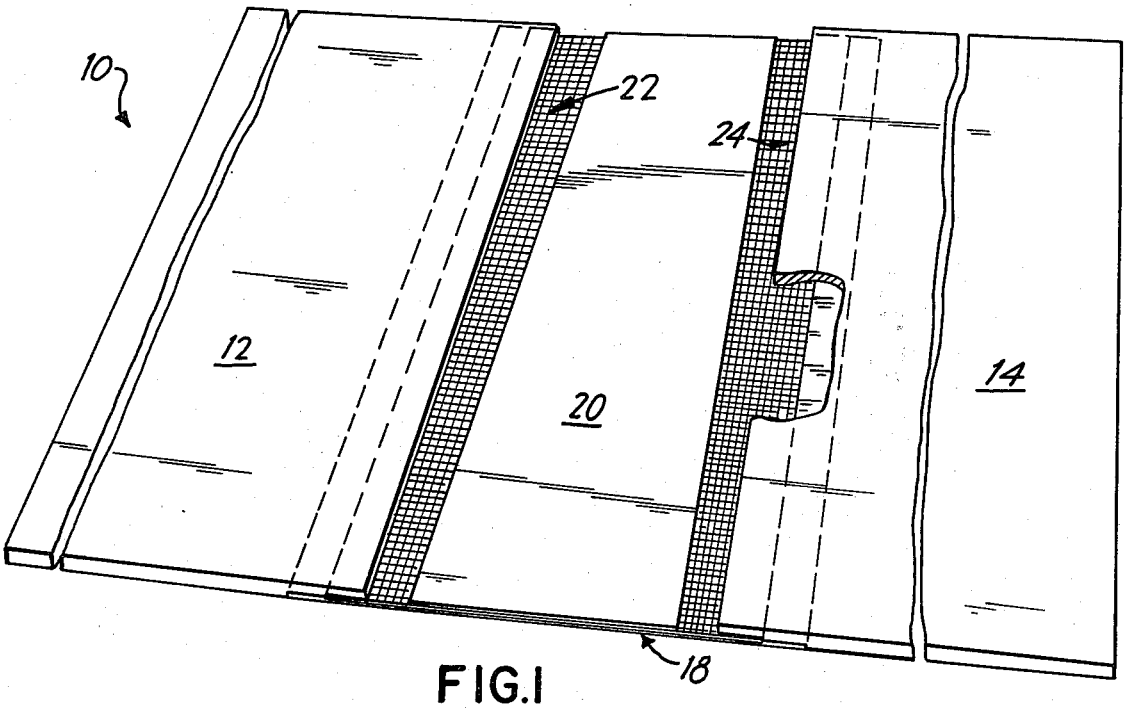
FIG. 1 is a perspective view of a book cover having a reinforced hinge in accordance with the present invention.
Figure 2:
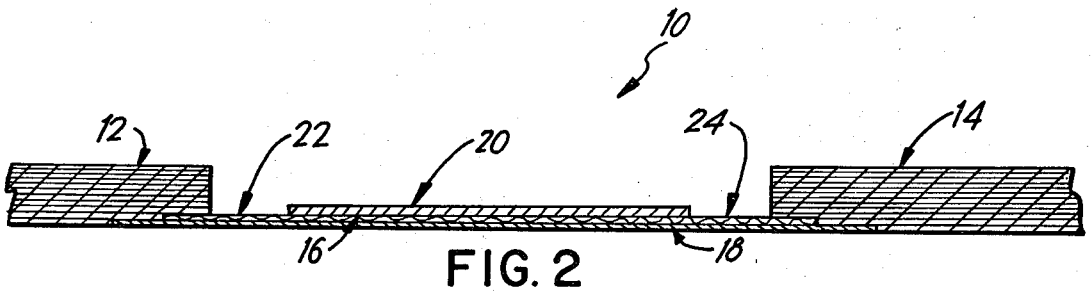
FIG. 2 is a cross-sectional view of a book cover and reinforced hinge formed in accordance with the present invention.
Figure 3:
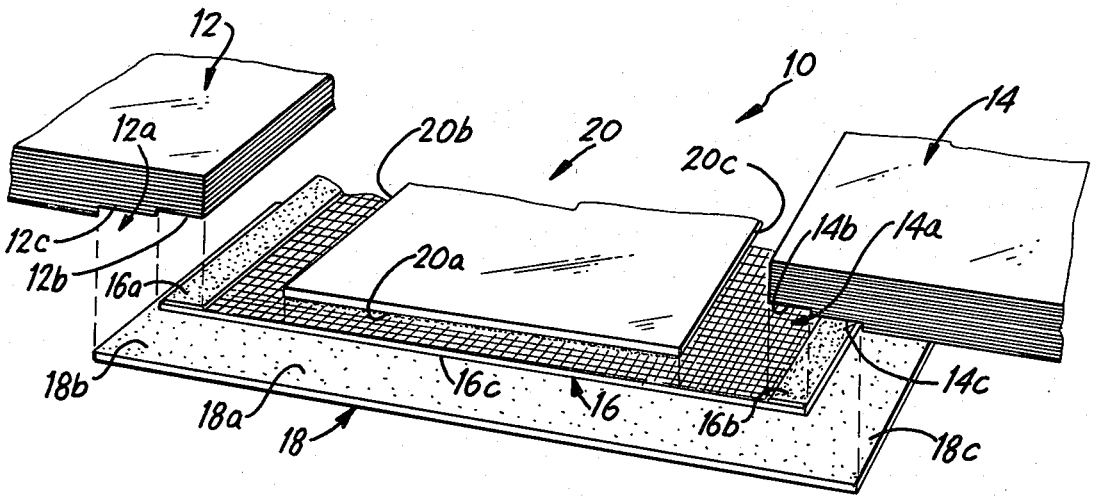
FIG. 3 is an exploded view of a book cover having a reinforced hinge in accordance with the present invention.

Referring to the drawings, there is shown a book cover having a reinforced hinge in accordance with the present invention, generally designated by the reference numeral 10. Leafboards 12, 14 are provided and are formed of paperboard material in the usual manner. In the preferred embodiment, one sheet of paperboard, or multiple plies of paperboard for heavier covers, is started with, and the resulting web is slit down its center and spaced apart to form the two leafboards 12, 14. The leafboards include respective edge portions 12*a*, 14*a* on their outer surfaces, for a purpose to be explained. Also, the leafboards 12, 14 are spaced apart so that edge portions 12*a*, 14*a* are opposite to each other and are in a parallel relationship.

The book cover 10 also includes a reinforcing member 16, such as a reinforcing scrim member. The reinforcing member 16 can be formed from any suitable reinforcing materials, such as nylon, cheesecloth, polyester, rayon, olefins, acrylics, acetates, or cotton. In the preferred embodiment, polyester scrim reinforcing material is preferred, since it provides the best combination of strength and stability. The reinforcing member 16 includes a first edge surface 16*a* and a second edge surface 16*b*, which edge surfaces are intended to be adhered to or secured to edge surfaces 12*b*, 14*b*, respectively, of edge portions 12*a*, 14*a* of leafboards 12, 14. In the preferred embodiment, glue is applied to edge surfaces 16*a*, 16*b* before such surfaces are brought into contact with edge surfaces 12*b*, 14*b* of the leafboards and adhered thereto. Alternatively, precoated reinforcing scrim 16 may be employed. As will be noted, after reinforcing member 16 is secured to spaced-apart leafboards 12, 14, spaces 12*c*, 14*c* remain on edge portions 12*a*, 14*a* of respective leafboards 12, 14, for a purpose to be explained.

The book cover 10 of the present invention also includes a hinge member 18 formed of paperboard or vinyl, which includes a central surface portion 18*a* and edge surfaces 18*b*, 18*c* formed on the ends of hinge member 18. In the preferred embodiment, glue or suitable adhesive, is applied to surfaces 18*a*, 18*b*, and 18*c*. Then, central surface portion 18*a*, with the glue thereon, is brought into contact with the outer surface 16*c* of reinforcing member 16 and is adhered thereto. As will be noted, the width of paperboard hinge member 18 is slightly wider than the width of reinforcing member 16. When the two members 16, 18 are brought into contact, they are arranged such that the edge surface 18*b* extends beyond one edge of reinforcing member 16 approximately ¼ inch, and the other edge surface 18*c* extends beyond the other edge of reinforcing member 16, approximately ¼ inch. In this manner, edge surface 18*b*, with the glue thereon, may be adhered to surface portion 12*c* of leafboard 12, and edge surface 18*c*, with the glue thereon, may be adhered to surface portion 14*c* of leafboard 14.

As a result, direct adherence is obtained between the edges 18*b*, 18*c* of the hinge member 18 and surfaces 12*c*, 14*c* of leafboards 12, 14. This direct adherence of the hinge member 18 to the leafboards 12, 14 provides a better and superior bond, as compared to having the reinforcing member 16 and the hinge member 18 being of the same length, and then adhering the hinge member 18 to the reinforcing member 16, and then adhering the reinforcing member 16 to the respective leafboards 12, 14, so that there is no direct contact between hinge member 18 and the leafboards. This latter arrangement, wherein the reinforcing member 16 and the hinge member 18 are of the same width, is intended to be included within the scope of the present invention, although in the preferred embodiment, hinge member 18 is wider than reinforcing member 16 to provide the direct adherence between the edges 18*b*, 18*c* of the hinge member 18 and the respective leafboards 12, 14.

The improved book cover 10 of the present invention also includes a strip of lining paper 20 formed of paperboard material and having suitable adhesive or glue on surface 20*a* thereof. The strip of lining paper 20 is then adhered to the central portion of reinforcing member 16, with the longitudinal edges 20*b*, 20*c* being spaced from edge portions 12*a*, 14*a* of leafboards 12, 14. As a result, reinforced hinge sections 22, 24 are formed by such spaces on either side of central reinforced hinge section 26.

Accordingly, as will be understood, reinforcing member 16 reinforces all of the hinge sections 22, 24, and 26, and its edges 16*a*, 16*b* are directly adhered to the respective leafboards 12, 14, so that this layer 16 is securely integrated and bound to the book cover structure 10 of the present invention. The outer paperboard hinge member 18 covers the irregular surface of reinforcing member 16 and provides additional strength and durability thereto, and is also directly adhered at its edges 18*b*, 18*c* to the respective leafboards 12, 14. In this manner, the reinforcing member 16 of the present invention is securely integrated into the composite structure of the improved book cover 10 of the present invention, without weakening the manner in which any of the other components, such as the leafboards 12, 14 and outer paperboard hinge member 18, are adhered together.

It is also noted that the improved reinforced hinge of the present invention can be used in either a round-back type book cover in which the hinge is not attached to the book cover, or in a tight-back type book cover in which the hinge is glued to the book cover.

In the preferred embodiment, edge portion 12*a* of leafboard 12 and edge portion 14*a* of leafboard 14 are each indented an amount at least equal to the thickness of the overlapping reinforcing member 16 and the thickness of the overlapping hinge member 18, so that the thicknesses of the respective leafboards 12, 14 are not increased by the overlapping members 16, 18. In the preferred embodiment, the reinforcing member 16 has a thickness of approximately six points and the paperboard hinge member 18 has a thickness of approximately 10 points. Therefore, edge portions 12*a*, 14*a* would be indented approximately 16 points, plus a certain amount for layers of glue, in order to accommodate these thicknesses. Leafboards 12, 14 may be indented in any suitable manner, such as by applying pressure to the paperboard along the edges thereof by suitable dies or the like.

It should also be understood that the abovedescribed method of forming the book cover 10 of the present invention does not have to be performed in the exact sequence described above. For example, lining paper strip 20 may be adhered to reinforcing member 16 before hinge member 18 is adhered to reinforcing member 16. In addition, reinforcing member 16, hinge member 18, and lining paper strip 20 may be adhered together before this assembly is adhered to the respective leafboards 12, 14.

In view of the foregoing, it will be appreciated that as a result of the present invention, the reinforcing member 16, the outer paperboard hinge member 18, and the inner lining paper 20 are all glued together and cooperate to form an improved reinforced hinge for a book cover having sections 22, 24, and 26, which have greater strength and durability to resist tearing and/or cracking during continued use.

A latitude of modification, change, and substitution is intended in the foregoing disclosure, and in some instances, some features of the invention will be employed without a corresponding use of other features. Accordingly, it is appropriate that the appended cl aims be construed broadly and in a manner consistent with the spirit and scope of the invention herein.

What is claimed is:

1. A method of forming a book cover having a reinforced hinge, comprising the steps of:

arranging first and second leafboards in spaced-apart relationship so that their respective first and second longitudinal edge portions are parallel to and spaced from each other;

overlapping said first and second edge portions with a reinforcing member and adhering the overlapping edges of said reinforcing member to the respective first and second edge portions of said leafboards;

overlapping the outer surface of said reinforcing member with a hinge member and adhering said hinge member to said reinforcing member and to the first and second edge portions of said leafboards;

overlapping the inner surface of said reinforcing member with lining material and adhering said lining material thereto such that the longitudinal edges of said lining material are spaced apart from the respective first and second edge portions of said leafboards; and said last two steps being performed in any order.

2. A method in accordance with claim 1 further including the step of indenting the first and second edge portions of said leafboards an amount at least equal to the thickness of said overlapping reinforcing member and lining material.

3. A method in accordance with claim 1 wherein said leafboards, said reinforcing member, said hinge, and said lining material are all adhered together by glue.

4. A book cover having a reinforced hinge, comprising:

first and second leafboards having respective first and second edge portions in opposed, spaced and parallel relationship;

a reinforcing member including first and second edges overlapping and being secured to said first and second edge portions, respectively;

a hinge member overlapping and adhered to the outer surface of said reinforcing member and extending beyond said first and second edges of said reinforcing member to overlap and directly adhere to said first and second edge portions of said leafboards, respectively;

a lining material overlapping and adhered to the inner surface of said reinforcing member, the longitudinal edges of said lining material being spaced from said first and second edge portions of said leafboards, respectively; and said reinforcing member, said hinge member, and said lining material, all being adhered together and cooperating to form a reinforced hinge for said book cover.

5. A book cover in accordance with claim 1 wherein said first and second edge portions of said leafboards are indented an amount at least equal to the thickness of said overlapping reinforcing member and said overlapping hinge member.

6. A book cover in accordance with claim 1 wherein said reinforcing member is adhered to said leafboards with glue.

7. A book cover in accordance with claim 1 wherein said hinge member is adhered to said reinforcing member and said leafboards with glue.

8. A book cover in accordance with claim 1 wherein said lining material is adhered to said reinforcing member with glue.

9. A book cover in accordance with claim 1 wherein said reinforcing member is formed of nylon.

10. A book cover in accordance with claim 1 wherein said reinforcing member is formed of cheesecloth.

11. A book cover in accordance with claim 1 wherein said reinforcing member is formed of polyester.

12. A book cover in accordance with claim 1 wherein said hinge member is formed of paperboard material.

13. A book cover in accordance with claim 1, wherein said hinge member is formed of vinyl material for heat sealing to said reinforcing member.

* * * * *

UNITED STATES PATENT AND TRADEMARK OFFICE

CERTIFICATE OF CORRECTION

PATENT NO. : 4,405,156
DATED : September 20, 1983
INVENTOR(S) : Leewood C. Carter, et al It is certified that error appears in the above—identified patent and that said Letters Patent is hereby corrected as shown below:

IN THE CLAIMS

Claim 5, line 1, change "Claim 1" to --Claim 4--.
Claim 6, line 1, change "Claim 1" to --Claim 4--.
Claim 7, line 1, change "Claim 1" to --Claim 4--.
Claim 8, line 1, change "Claim 1" to --Claim 4--.
Claim 9, line 1, change "Claim 1" to --Claim 4--.
Claim 10, line 1, change "Claim 1" to --Claim 4--.
Claim 11, line 1, change "Claim 1" to --Claim 4--.
Claim 12, line 1, change "Claim 1" to --Claim 4--.
Claim 13, line 1, change "Claim 1" to --Claim 4--.

Signed and Sealed this

Twenty-fifth Day of November, 1986

*Attest:*

DONALD J. QUIGG

*Attesting Officer* *Commissioner of Patents and Trademarks*

REEXAMINATION CERTIFICATE (577th)

United States Patent [19]

Carter et al.

[11] B1 4,405,156

[45] Certificate Issued Oct. 7, 1986

[54] REINFORCED HINGE FOR BOOK COVER

[75] Inventors: Leewood C. Carter, Warren; Robin P. Neary, Basking Ridge, both of N.J.

[73] Assignee: Book Covers, Inc., Newark, N.J.

Reexamination Request:
No. 90/000,748, Apr. 1, 1985

Reexamination Certificate for:

| | |
|---|---|
| Patent No.: | **4,405,156** |
| Issued: | **Sep. 20, 1983** |
| Appl. No.: | **249,089** |
| Filed: | **Mar. 30, 1981** |

[51] Int. Cl.[4] ..... B42C 7/00; B42D 3/06
[52] U.S. Cl. ..... 281/29; 412/3
[58] Field of Search ..... 281/29, 36, 37; 412/3-6

[56] References Cited

U.S. PATENT DOCUMENTS

| | | | |
|---|---|---|---|
| 1,913,969 | 6/1933 | Wood . | |
| 3,145,033 | 8/1964 | Caddoo | 281/29 |
| 3,273,913 | 9/1966 | Carter et al. | 281/29 |

FOREIGN PATENT DOCUMENTS

| | | |
|---|---|---|
| 1099991 | 2/1961 | Fed. Rep. of Germany . |
| 964283 | 8/1950 | France . |
| 69877 | 1/1946 | Norway . |
| 345869 | 6/1960 | Switzerland . |
| 1044481 | 9/1961 | United Kingdom . |

*Primary Examiner*—Paul A. Bell

[57] ABSTRACT

A book cover having a reinforced hinge including a reinforcing member secured to the edges of the leafboards of the book cover, a hinge member secured to the outer surface of the reinforcing member, and a central lining paper adhered to the inner surface of the reinforcing member, so that the composite structure cooperates to form a reinforced hinge for a book cover.

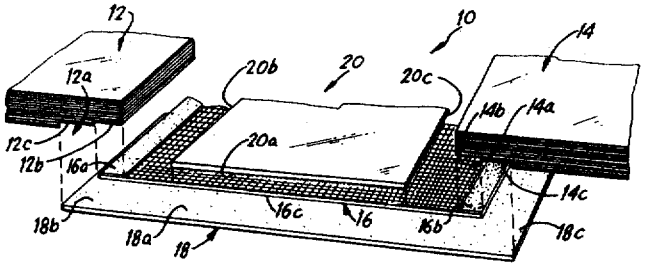

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 4 are determined to be patentable as amended.

Claims 3 and 5-13, dependent on an amended claim, are determined to be patentable.

1. A method of forming a book cover having a reinforced hinge, comprising the steps of:

arranging first and second leafboards in spaced-apart relationship so that their respective first and second longitudinal edge portions are parallel to and spaced from each other;

overlapping said first and second edge portions with a reinforcing *scrim* member and adhering the overlapping edges of said reinforcing member to the respective first and second edge portions of said leafboards;

overlapping the outer surface of said reinforcing member with a *paperboard* hinge member and adhering said hinge member to said reinforcing member and to the first and second edge portions of said leafboards;

overlapping the inner surface of said reinforcing member with lining material and adhering said lining material thereto, such that the longitudinal edges of said lining material are spaced apart from the respective first and second edge portions of said leafboards; and said last two steps being performed in any order.

2. A method in accordance with claim 1 further including the step of indenting the first and second edge portions of said leafboards an amount at least equal to the thickness of said overlapping reinforcing member and [lining material] *said hinge member.*

4. A book cover having a reinforced hinge, comprising:

first and second leafboards having respective first and second edge portions in opposed, spaced and parallel relationship;

a reinforcing *scrim* member including first and second edges overlapping and being secured to said first and second edge portions, respectively;

a *paperboard* hinge member overlapping and adhered to the outer surface of said reinforcing member and extending beyond said first and second edges of said reinforcing member to overlap and directly adhere to said first and second edge portions of said leafboards, respectively;

a lining material overlapping and adhered to the inner surface of said reinforcing member, the longitudinal edges of said lining material being spaced from said first and second edge portions of said leafboards, respectively; and said reinforcing member, said hinge member, and said lining material, all being adhered together and cooperating to form a reinforced hinge for said book cover.

* * * * *